US010702451B2

(12) United States Patent
Lum

(10) Patent No.: US 10,702,451 B2
(45) Date of Patent: Jul. 7, 2020

(54) METHODS AND SYSTEMS FOR GROUPING PHARMACEUTICAL CONTAINERS ACCORDING TO GROUPING PREFERENCES

(71) Applicant: Samuel Lum, San Ramon, CA (US)

(72) Inventor: Samuel Lum, San Ramon, CA (US)

( * ) Notice: Subject to any disclaimer, the term of this patent is extended or adjusted under 35 U.S.C. 154(b) by 147 days.

(21) Appl. No.: 15/658,478

(22) Filed: Jul. 25, 2017

(65) Prior Publication Data

US 2018/0028399 A1 Feb. 1, 2018

Related U.S. Application Data

(60) Provisional application No. 62/366,745, filed on Jul. 26, 2016.

(51) Int. Cl.

| | |
|---|---|
| ***A61J 1/03*** | (2006.01) |
| ***B65B 17/02*** | (2006.01) |
| ***B65C 1/02*** | (2006.01) |
| ***B65D 71/50*** | (2006.01) |

(52) U.S. Cl.

CPC ..... *A61J 1/03* (2013.01); *B65B 17/025* (2013.01); *B65C 1/02* (2013.01); *B65D 71/50* (2013.01); *A61J 2200/30* (2013.01); *A61J 2205/30* (2013.01)

(58) Field of Classification Search

CPC .. B65B 17/025; B65C 1/02; A61J 7/04; A61J 1/16; A61J 1/03

USPC ..... 206/528, 538, 534

See application file for complete search history.

(56) References Cited

U.S. PATENT DOCUMENTS

| | | | | |
|---|---|---|---|---|
| 7,017,759 | B1 | 3/2006 | Friend | |
| 9,427,377 | B1 * | 8/2016 | Miceli | A61J 7/04 |
| 2005/0218031 | A1 * | 10/2005 | Murphy | B65D 21/0204 206/538 |
| 2011/0036214 | A1 * | 2/2011 | Potterfield | B25B 13/48 81/467 |
| 2011/0259782 | A1 * | 10/2011 | Adamucci | A61J 1/03 206/534 |
| 2013/0030566 | A1 * | 1/2013 | Shavelsky | A61J 7/04 700/244 |
| 2013/0195326 | A1 * | 8/2013 | Bear | G06F 19/3456 382/128 |
| 2015/0209226 | A1 * | 7/2015 | Priebe | B65D 43/22 206/538 |
| 2017/0156986 | A1 * | 6/2017 | Campbell | A61J 7/04 |

FOREIGN PATENT DOCUMENTS

| | | | | |
|---|---|---|---|---|
| WO | WO-9210410 A1 * | 6/1992 | | B65D 71/50 |

* cited by examiner

*Primary Examiner* — Rafael A Ortiz

(74) *Attorney, Agent, or Firm* — Matthew M. Googe; Robinson IP Law, PLLC

(57) ABSTRACT

Pharmaceutical compliance systems for improving patient compliance in taking a plurality of pharmaceutical medications. The pharmaceutical compliance systems include a plurality of compliance holders each having a plurality of retainers. Each of the plurality of retainers are configured for securing an individualized pharmaceutical container to the compliance holder for grouping the plurality of plurality of medications according to one or more preferred grouping preferences.

8 Claims, 6 Drawing Sheets

METHODS AND SYSTEMS FOR GROUPING PHARMACEUTICAL CONTAINERS ACCORDING TO GROUPING PREFERENCES

CROSS-REFERENCE TO RELATED APPLICATION

This application is a non-provisional to U.S. Provisional Application Ser. No. 62/366,745 filed Jul. 26, 2016, entitled "Compliance Cards for Grouping Pharmaceutical Containers According to Dosage Requirements," the contents of which is incorporated herein by reference.

FIELD

This disclosure relates to a compliance system for pharmaceuticals. More particularly, this disclosure relates to a set of compliance holders for grouping pharmaceutical containers, particularly prescription pharmaceutical containers, according to certain grouping preferences such as therapeutic classifications (e.g., type of disease) and/or dosage requirements (e.g., frequency, time of day, whether to be taken with or without food) of the pharmaceuticals housed in the containers.

BACKGROUND

Lack of medication adherence and compliance by patients is a significant and costly problem. Medication adherence (i.e., taking the right medicine in the right doses and on the right schedule) averages only approximately 50% among patients with chronic conditions in developed countries, including the United States. Patients not taking medications as prescribed puts them at risk for serious adverse health conditions, including death. The leading cause of non-compliance is behavioral; that is, the patient is forgetful or procrastinates, thus missing a dose or being late in obtaining a renewal or refill of a prescription.

Further, non-compliance accounts for approximately 12% of total health care expenditures in the United States. Non-adherence results in frequent re-admissions and additional hospitalizations, emergency department visits, diagnostic tests, physician office visits, and surgeries and other procedures. It is estimated that medication non-adherence results is an annualized cost of from $290 billion to $319 billion to the U.S. healthcare system.

A variety of ways to encourage compliance are known in the prior art, but with limited success. Accordingly, what is needed is a system and method that addresses the root causes of non-compliance, and encourages medication adherence, reconciliation, and synchronization by both patients and trained health care professionals.

SUMMARY

The disclosure advantageously provides a pharmaceutical compliance system for improving patient compliance in taking a plurality of pharmaceutical medications wherein each of the plurality of pharmaceutical medications are disposed in individualized pharmaceutical containers. The pharmaceutical compliance system includes a plurality of compliance holders each having a plurality of retainers wherein each of the plurality of retainers are configured for securing one of the plurality of pharmaceutical medications in its individualized pharmaceutical container for grouping the plurality of pharmaceutical medications to each of the plurality of compliance holders according to one or more preferred grouping preferences.

According to certain embodiments, the pharmaceutical compliance system further includes a plurality of labels each having indicia corresponding to a plurality of grouping preferences for securing to one of the plurality of compliance holders based on the preferred grouping preference assigned to the compliance holder.

According to certain embodiments, each of the plurality of compliance holders includes a bottom portion and a flexible top portion, the bottom portion including a plurality of bottom rings connected by a bottom joining member and the top portion including a plurality of top rings connected by a top joining member, each of the plurality of top rings including a gap portion distal from the top joining member for securing a pharmaceutical container to each of the plurality of top rings according to the preferred grouping preference of the compliance holder.

According to certain embodiments, each of the plurality of retainers of each compliance holder are configured to be selectively removable from adjacent retainers.

According to another embodiment of the disclosure, a method for improving patient compliance in taking a plurality of pharmaceutical medications wherein each of the plurality of pharmaceutical medications are disposed in individualized pharmaceutical containers includes providing a plurality of compliance holders each having a plurality of retainers, each of the plurality of retainers configured for securing one of the plurality of pharmaceutical medications in its individualized pharmaceutical container to the compliance holder; assigning a grouping preference for each of the plurality of compliance holders; selecting pharmaceutical containers that correspond to the assigned grouping preference of each compliance holder; and securing each of the selected pharmaceutical containers to the retainers of the assigned compliance holder that corresponds to the grouping preference of the selected pharmaceutical container.

According to certain embodiments, the grouping preferences include a dosage time grouping preference, a drug synergy grouping preference, or grouping pharmaceutical containers based at least in part on a medical condition or therapeutic class the pharmaceutical medication secured to the compliance holder is intended to treat.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
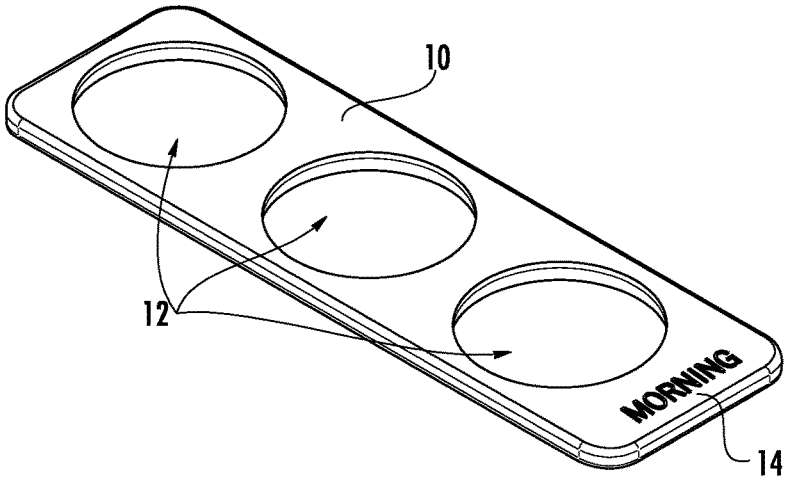
FIGS. 1-3 are overhead perspective views of compliance holders 10, 20, and 30, respectively, according to one embodiment of the disclosure.

The disclosure relates to a pharmaceutical compliance system in which a plurality of pharmaceutical containers housing particular pharmaceuticals are able to be secured together using compliance holders described below according to a particular grouping preference for the pharmaceuticals housed in the containers. For purposes of the present disclosure, each pharmaceutical container housing a particular pharmaceutical is referred to as an "individualized pharmaceutical container" because the container holds only one particular pharmaceutical. In preferred embodiments, the pharmaceuticals are prescription medications housed in their original prescription containers as dispensed by a pharmacy. However, it should be understood that the "pharmaceuticals" and "medications" could refer to other types of pills such as over-the-counter medications, vitamins, supplements, etc. that are dispensed in individualized pharmaceutical containers. While many "grouping preferences" are possible as discussed below, preferred grouping preferences include organizing the individualized containers to the compliance holders by therapeutic classifications (e.g., type of disease) and/or dosage requirements (e.g., frequency, time of day, whether to be taken with or without food).

In certain embodiments, the pharmaceuticals are prescription pharmaceuticals and the grouping preference is a dosage schedule relating to the time of day in which the prescription pharmaceuticals are scheduled to be taken as prescribed. For example, as exemplified below, individualized containers housing prescriptions to be taken only once per day, such as in the morning, are grouped together using a first compliance holder, while containers housing prescriptions to be taken twice a day, such as morning and evening, are grouped together using a second compliance holder. Thus, in this example, a user takes all the medications in the morning from the containers of both the first and second compliance holders and then takes only the medications from the containers of the second compliance holder in the evening. Such a system enhances compliance by encouraging medication adherence and reinforcing to the user which medications are to be taken at particular times of the day. As should be understood from the disclosure herein, numerous grouping preferences are possible and within the scope of the present disclosure to enhance compliance by encouraging and assisting medication adherence.

Referring to FIGS. 1-6, one embodiment of the present compliance system is depicted with reference to a dosage schedule grouping preference. As shown, the system of this embodiment includes three compliance holders 10, 20, 30 each including a plurality of retainers 12, 22, 32 for securing one individualized medication container to each of the respective retainers. While different configurations of the compliance holders 10, 20, 30 and corresponding retainers 12, 22, 32 are within the scope of the present disclosure, FIGS. 1-6 exemplify one embodiment in which the holders 10, 20, 30 are configured as compliance cards 10, 20, 30 each having a plurality of apertures 12, 22, 32 for securing medication containers to the cards 10, 20, 30.

Figure 2:
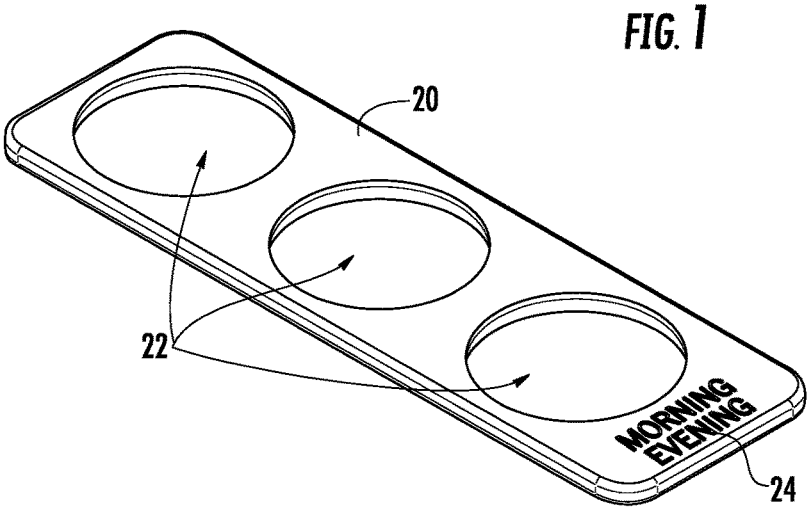
Figure 3:
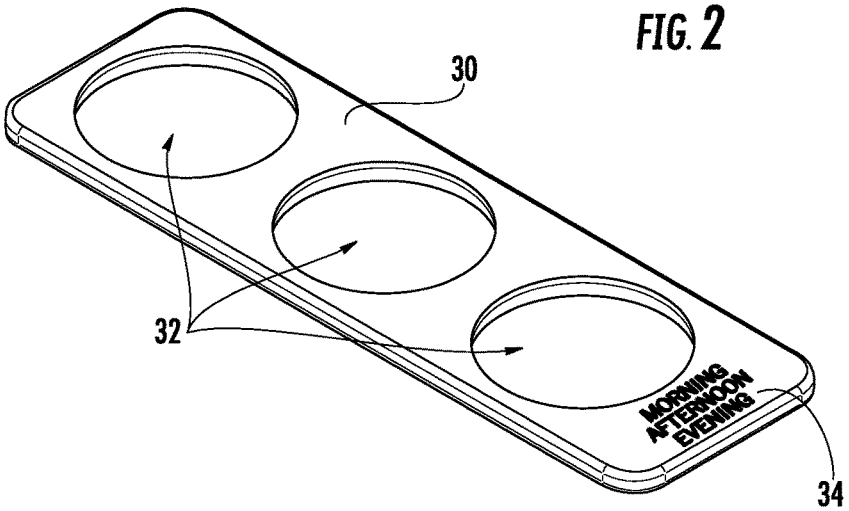
Figure 4:
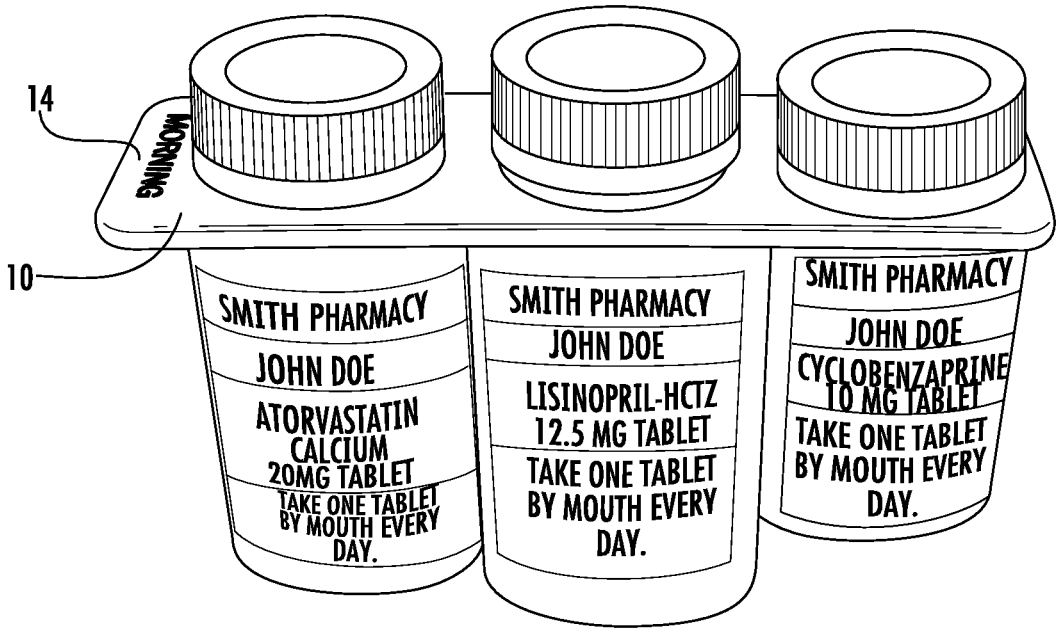
FIGS. 4-6 are perspective views of individualized pharmaceutical containers secured to appropriate compliance holders according to one embodiment of the disclosure.
Figure 5:
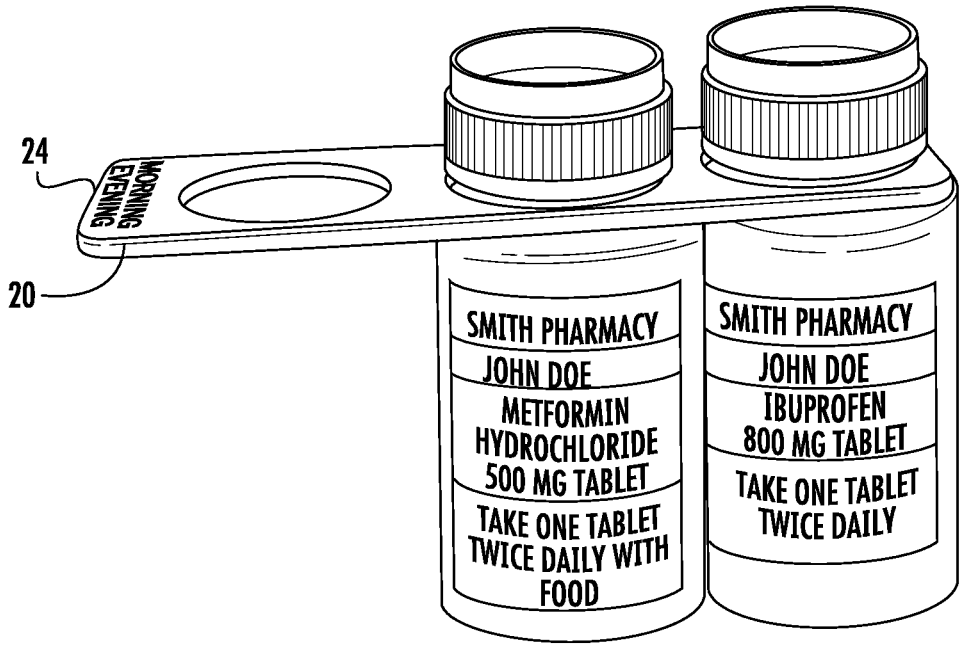
Figure 6:
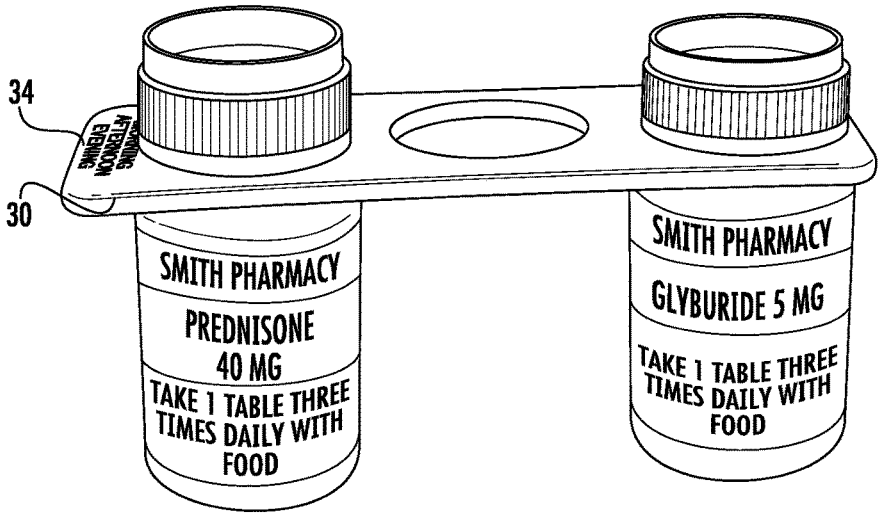

Referring to FIGS. 1 and 4, the first compliance holder 10 is intended to receive individualized medication containers in retainers 12 containing pharmaceuticals that are prescribed to be taken once a day, typically in the morning. Referring to FIGS. 2 and 5, the second compliance holder 20 is intended to receive medication containers in retainers 22 containing pharmaceuticals that are prescribed to be taken twice a day, typically morning and evening. Referring to FIGS. 3 and 6, the third compliance holder 30 is intended to receive medication containers in retainers 32 containing pharmaceuticals that are prescribed to be taken three times a day, typically morning, afternoon, and evening.

As shown, each compliance holder 10, 20, 30 preferably includes indicia 14, 24, 34 either molded into the compliance holder or on a label applied thereto that identifies the grouping preference of the particular compliance holder. For example, referring to the dosage schedule grouping preference embodiment of FIGS. 1-10, the indicia 14, 24, 34 indicates when the pharmaceuticals in the containers secured to the particular compliance holder 10, 20, 30 are to be taken. For example, compliance holder 10 is intended to receive medication containers containing pharmaceuticals to be taken once a day in the morning, and thus, includes indicia stating "MORNING." Similarly, compliance holder 20 includes indicia stating "MORNING & EVENING" while compliance holder 30 includes indicia stating "MORNING, AFTERNOON & EVENING." In addition to or in replace of the indicia, each compliance holder my be provided in a different color to signify how many times a day the medication in the containers secured to the respective holder are to be taken. For example, according to this embodiment, compliance holder 10 is blue, compliance holder 20 is red, and compliance holder 30 is green.

While compliance holders 10, 20, 30 are shown as each having three retainers, it should be noted that the holders may have any number of retainers as desired. Further, different holders could be provided such that a user can pick a particular holder based on the number of pharmaceuticals being taken at particular times of the day. For example, suppose a person is prescribed the following schedule of prescription medications: (1) prescriptions A and B to be taken once every morning; (2) prescriptions C, D, and E to be taken in the morning and evening; and (3) prescriptions F and G to be taken morning, afternoon, and evening. According to this schedule, a user may choose a compliance holder 10 that includes two apertures for the two containers housing prescriptions A and B; a compliance holder 20 that includes three apertures for the three containers housing prescriptions C, D, and E; and a compliance holder 30 that includes two apertures for the two containers housing prescriptions F and G. Alternately, each holder 10, 20, and 30 includes the same number of apertures, and certain apertures are left empty if they are not needed (as exemplified in FIGS. 5 and 6).

According to the embodiment of FIGS. 1-6, the individualized containers are secured to the compliance holders by inserting the neck of a particular container through one of the apertures of the holder and then screwing a closure onto the container. Alternately, the apertures could include tab elements that allow the threads and transfer bead of the container neck to pass up through a holder retainer but prevent the transfer bead from going back down through the aperture. Thus, according to this alternate embodiment, the retainers of the holders are designed so that containers, once secured to the holder, are not generally removable. In yet another embodiment, the tab elements preventing removal of the containers from the retainers could be deformable and/or include a release mechanism to allow selective removal of the containers from the compliance holder retainers. According to any of these embodiments, the apertures are preferably configured such that a user can freely rotate the containers when they are secured to the compliance holders for reading the prescription labels on the containers as desired.

While grouping the containers by how many times the pharmaceuticals housed in the containers are to be taken each day is described above and exemplified in FIGS. 1-6, it should be understood that the compliance holders can be used to group pharmaceutical containers in a variety of manners and according to a variety of grouping preferences. For example, each compliance holder could be used to group containers housing all the pharmaceuticals to be taken at a particular time of day. Using the schedule described above where a person is prescribed (1) prescriptions A and B to be taken once every morning; (2) prescriptions C, D, and E to be taken in the morning and evening; and (3) prescriptions F and G to be taken morning, afternoon, and evening, the system would include a first compliance holder having containers housing prescriptions A, B, C, D, E, F, and G to be taken in the morning, a second compliance holder having containers housing prescriptions F and G to be taken in the afternoon, and a third compliance holder having containers housing prescriptions A, B, C, D, E, F, and G to be taken in the evening. While this system would typically require holders with more retainers and the pharmacy to dispense the prescriptions in additional containers, or the patient to redispense each of their prescriptions into separate containers where each container corresponds to a particular time of day for that prescription to be taken, it exemplifies other ways in which the compliance holders described above may be utilized.

According to another embodiment, the compliance holders described above may be used to group a plurality of medications according to particular therapeutic regimens/classifications. For example, many patients with certain diseases/ailments such as diabetes and HIV are prescribed multiple drugs to be taken at different times of the day for treating/managing their diseases/ailments. Further, many of these patients may have multiple diseases/ailments that each require multiple pharmaceuticals. Thus, to increase compliance, the patient may sort their containers by particular diseases/ailments using the compliance holders described herein (e.g., a blue holder for all diabetes related medications, a red holder for HIV related medications, etc.).

Similarly, compliance holders are particularly well suited for grouping combinations of drugs that are intended to be taken together at a particular time for a particular disease or therapeutic class. For example, the patient may be prescribed a particular drug regimen for HIV where the patient is supposed to take certain drugs at a particular dosage at the same time. Thus, the present disclosure allows the patient to group the drugs together by the particular disease and dosage time.

It should be understood that countless other grouping preferences are possible and contemplated herein such as grouping containers together by household member (e.g., a blue compliance holder may be used to group all of the husband's pharmaceuticals together and a pink compliance holder may be used to group all of the wife's pharmaceuticals together); grouping containers by frequency (e.g., drugs taken once per day are grouped together using one compliance holder while drugs taken twice a day are grouped together using a separate compliance holder); grouping containers by types of warning information or drug interactions (e.g., drugs to be taken with food are grouped together, drugs not to be taken with dairy are grouped together, drugs preventing operating of machinery are grouped together, etc.); grouping containers by refill date (e.g., containers containing 30 day prescriptions are grouped together using one compliance holder while 15 day prescriptions are grouped together using another compliance holder); grouping containers by container size (e.g., larger containers grouped together using one compliance holder having appropriately sized retainers for larger containers and smaller containers grouped together using another compliance holder having appropriately sized retainers for smaller containers); grouping containers by age of the prescription (e.g., prescriptions prescribed recently such as active prescriptions grouped together using one compliance holder and older prescriptions grouped together using another compliance holder); grouping containers by copay amount; etc.

According to certain embodiments of the disclosure, a pharmacist may dispense prescriptions to a patient using the compliance holders. In other embodiments, the compliance holders are sold as aftermarket products and the patient or the patient's caregiver uses the compliance holders to group the patient's prescription containers by the patient's particular grouping preference. In either embodiment, the plurality of compliance holders may be sold as a kit with a label set including a plurality of labels having varying indicia according to more popular grouping preferences. In other words, the kit allows the pharmacist or patient to determine a particular grouping preference for each compliance holder and label each compliance holder with an appropriate label from the label set based on the chosen grouping preference.

Figure 7:
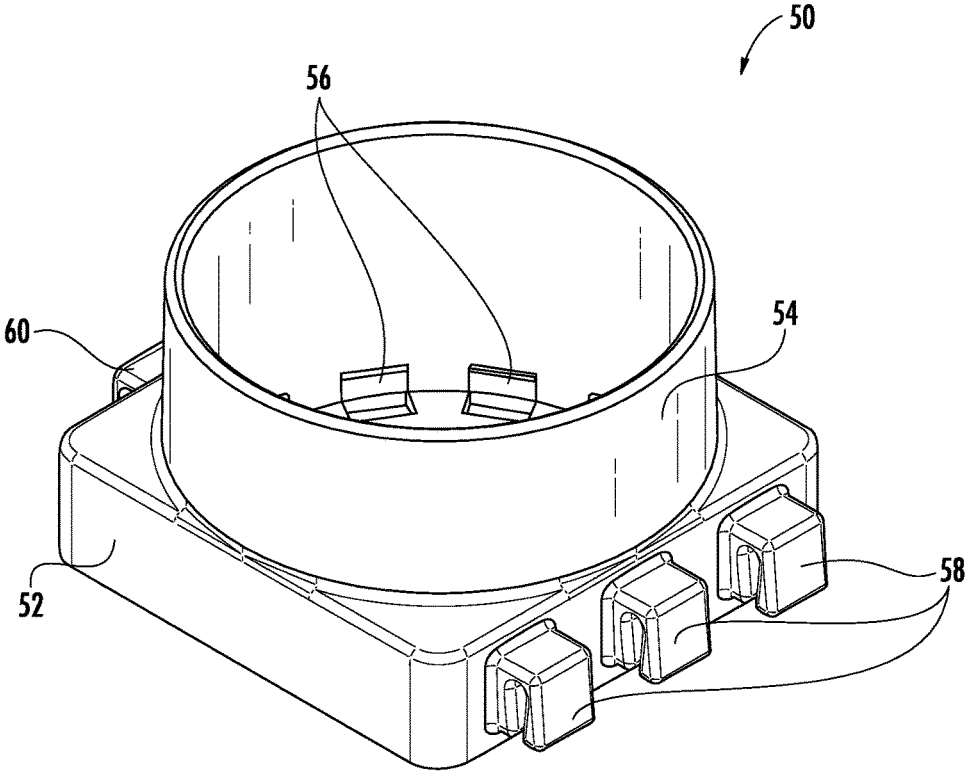
FIG. 7 is a perspective view a compliance base cup according to one embodiment of the disclosure.
Figure 8:
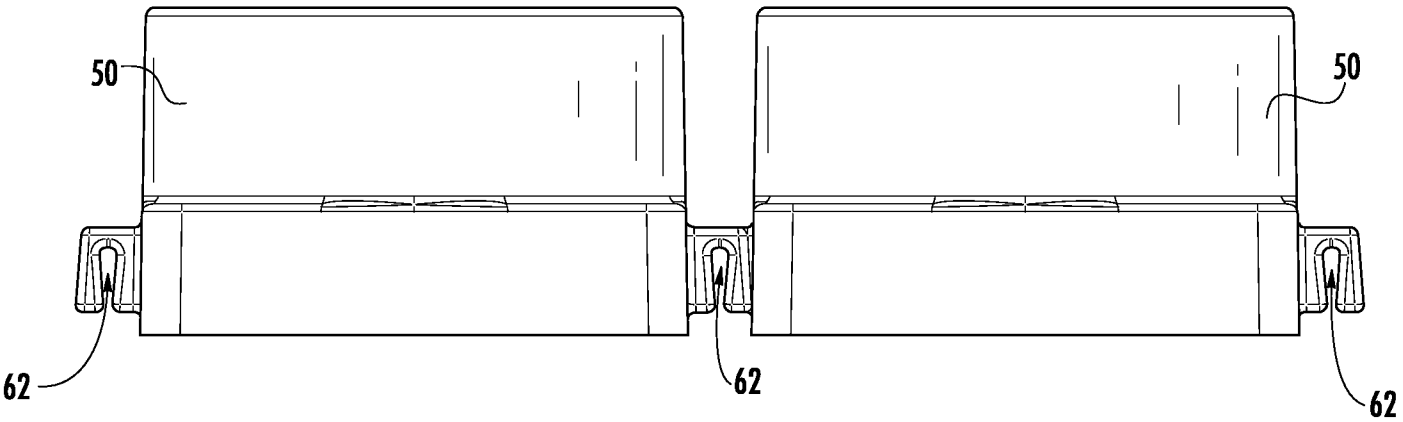
FIG. 8 is a side view of a plurality of base cups in a removably secured position to form a compliance holder according to one embodiment of the disclosure.

Referring to FIGS. 7-8, another embodiment of the present disclosure is shown where each compliance holder is constructed, such as by the end user or potentially a pharmacist as described above, using a chosen number of retainers 50, with each retainer 50 preferably configured to receive one pharmaceutical container. The advantage of this embodiment is that a user is able to easily and efficiently construct each compliance holder according to the user's own grouping requirements. For example, if a "morning" compliance holder only needs to group two pharmaceutical containers together, it would be inefficient to have a holder that has three retainers (e.g., the holder would take up more space in a medicine cabinet, requires more material to make the holder, unused holders could be confusing, etc.). Similarly, it would be inefficient to provide compliance holders having a large number of retainers in an attempt to make sure there were enough retainers for most every grouping circumstance when a large number of groupings would not need as many retainers.

According to this embodiment, each retainer 50 is configured as a "cup" to securely receive the bottom portion of a pharmaceutical container. As shown, each retainer 50 preferably includes a base portion 52, a cylindrical sidewall 54 extending upwards from the base portion 52, and deformable tabs 56 disposed within the cylindrical sidewall 54 adjacent the base portion 52 for gripping the bottom of a container received within sidewall 54. According to alternate embodiments, the deformable tabs 56 are omitted and the cylindrical sidewall 54 includes a diameter only slightly larger than the diameter of a container intended to be securely received within the retainer 50. According to other embodiments, the sidewall 54 of retainer 50 is dimensioned and configured to receive a larger container but allows for inserts to be received within the sidewall 54 such that the retainer 50 may be configured to receive various sized containers using a variety of inserts.

In order to removably secure a plurality of retainers 50 together to make a compliance holder having a chosen number of retainers 50, the base portion 52 of each retainer 50 includes a first engaging mechanism 58 disposed on one side of the base portion 52 and a second engaging mechanism 60 disposed on a second side of the base portion 52 opposite the side of the first engaging mechanism 58. To connect multiple retainers 50 together, the first engaging mechanism 58 and second engaging mechanism 60 are configured to connect to corresponding engaging mechanisms of an adjacent retainer 50. While many different engagement mechanisms are known in the art and contemplated within the scope of the present disclosure, the engaging mechanisms of retainers 50 of FIGS. 7-8 include a plurality of protrusions having slots 62 (best shown in FIG. 8) that are operable to be aligned such that a pin, rod, key, etc. may be inserted through adjacent protrusions when the first engaging mechanism 58 of one retainer 50 is aligned with the second engaging mechanism 60 of a second retainer (as shown best in FIG. 8 with the slots 62 aligned prior to pin or other object being inserted through the aligned slots 62).

While the retainers 50 of this embodiment are configured as "cups" to receive the bottoms of containers, it should be understood that retainers 50 may take various forms including slots within a base portion for receiving the necks of containers as described above with respect to compliance holders 10, 20, 30. Similarly, as noted above, it should be understood that the retainers 50 may be removeably attached to each other in a variety of manners as known in the art.

Figure 9:
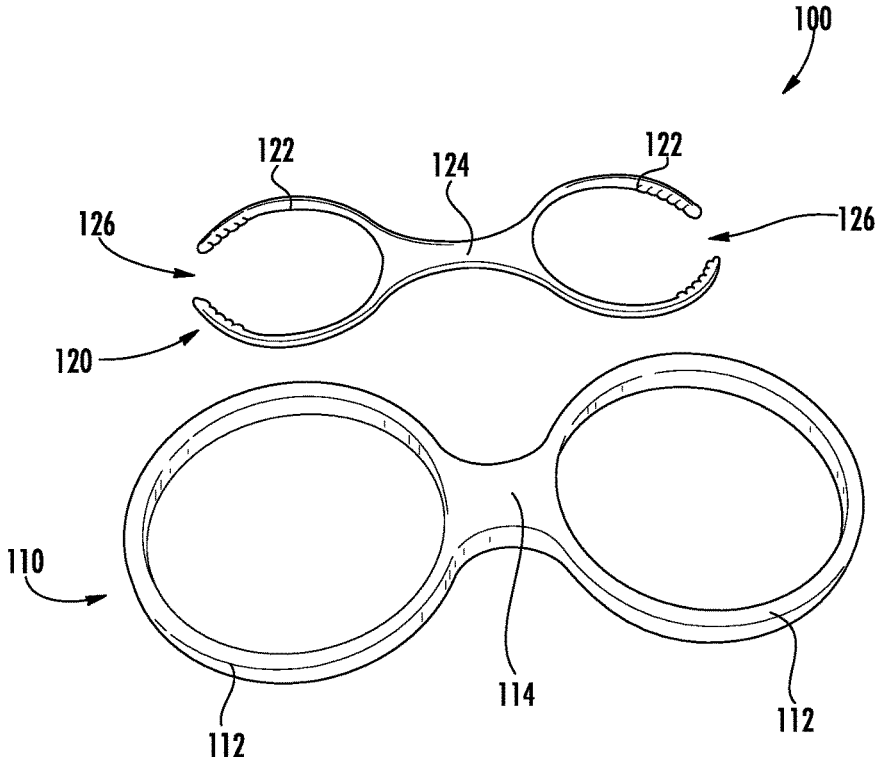
FIG. 9 is a perspective view of a compliance holder according to another embodiment of the disclosure.
Figure 10:
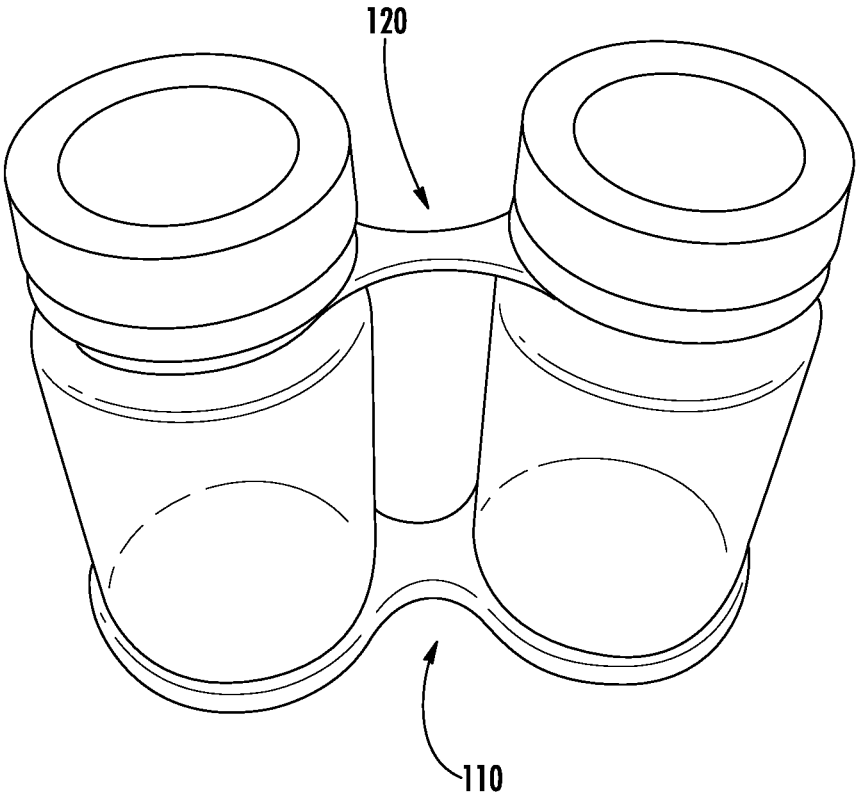
FIG. 10 is a perspective view of the compliance holder of FIG. 9 grouping two containers together according to one embodiment of the disclosure.

Referring to FIGS. 9-10, yet another embodiment of the present disclosure is shown with each compliance holder 100 including a bottom portion 110 and a flexible top portion 120. The bottom portion 110 includes a plurality of bottom rings 112 connected by a joining member 114 that performs a similar function as the "cups" of FIGS. 7-8 except they are intended more to stabilize the bottom portions of the containers together instead of securely receiving the containers. The top portion 120 similarly includes a plurality of top rings 122 connected by a joining member 124. To secure the containers together, each of the top rings 122 include gap portions 126 at a portion of each rings 122 distal from the joining member 124. The top portion 120 of the compliance holder 100 operates to removably receive the neck of containers by pushing the neck of each container intended to be grouped together through one of the gap portions 126 to be received by one of the top rings 122. Together, the bottom portion 110 and top portion 120 securely receive containers by the bottom rings 112 being disposed around the bottom portions of the containers and the corresponding top rings 122 being disposed around the necks of the containers. While FIGS. 9-10 depict a compliance holder 100 configured to receive two containers, it should be understood that a plurality of compliance holders 100 can be provided that are configured to group a different numbers of containers by a varying number of bottom rings 112 and corresponding top rings 122 for each compliance holder.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A method for improving patient compliance in taking a plurality of pharmaceutical medications comprising:

providing the plurality of pharmaceutical medications with each of the plurality of pharmaceutical medications being disposed in an individualized pharmaceutical container provided by one of a pharmacy and commercial pharmaceutical company and housing only one of the plurality of pharmaceutical medications placed into the individualized pharmaceutical container by one of the pharmacy and commercial pharmaceutical company, the individualized pharmaceutical container being an original prescription container dispensed by the pharmacy;

providing a plurality of compliance holders including a bottom portion and a top portion, each of the plurality of compliance holders having a plurality of retainer apertures formed therethrough, each of the plurality of retainer apertures configured for fitting around at least a portion of one of the individual pharmaceutical containers thereby securing at least one of the individualized pharmaceutical containers to the compliance holder;

assigning a distinct grouping preference for each of the plurality of compliance holders;

determining, for each of the plurality of pharmaceutical medications, an appropriate grouping preference for the pharmaceutical medication from the distinct grouping preferences of the plurality of compliance holders;

determining, for each of the individualized pharmaceutical containers, an appropriate compliance holder for the individualized pharmaceutical container by matching the appropriate grouping preference for the pharmaceutical medication disposed in the individualized pharmaceutical container to the compliance holder assigned the same grouping preference; and securing each of the individualized pharmaceutical containers to one of the plurality of retainers of the appropriate compliance holder for the individualized pharmaceutical container by locating at least a portion of each of the individualized pharmaceutical containers through at least one of the retainer apertures formed through the top portion and bottom portion of the compliance holders.

2. The method of claim 1 wherein the grouping preferences include a dosage time grouping preference.

3. The method of claim 1 wherein the grouping preferences include a drug synergy grouping preference.

4. The method of claim 1 wherein the grouping preferences includes grouping pharmaceutical containers based at least in part on a medical condition or therapeutic class the pharmaceutical medication secured to the compliance holder is intended to treat.

5. The method of claim 1 further comprising providing a plurality of labels each having indicia corresponding to a plurality of grouping preferences and securing to each of the plurality of compliance holders one of the plurality of labels based on the grouping preference assigned to the compliance holder.

6. The method of claim 1 wherein the individualized pharmaceutical containers are prescription containers and the plurality of pharmaceutical medications are prescription medications.

7. The method of claim 1, wherein the individualized pharmaceutical containers further comprise dispense prescription labels located on each of the individual pharmaceutical containers, the dispense prescription labels provided by the pharmacy.

8. A method for improving patient compliance in taking a plurality of pharmaceutical medications comprising:

providing the plurality of pharmaceutical medications with each of the plurality of pharmaceutical medications being disposed in an individualized pharmaceutical container housing only one of the plurality of pharmaceutical medications;

providing a plurality of compliance holders each having a plurality of retainers, each of the plurality of retainers configured for securing one of the individualized pharmaceutical containers to the compliance holder wherein each of the plurality of compliance holders includes a bottom portion and a flexible top portion, the bottom portion including a plurality of bottom rings connected by a bottom joining member and the top portion including a plurality of top rings connected by a top joining member, each of the plurality of top rings including a gap portion distal from the top joining member for securing a pharmaceutical container to each of the plurality of top rings according to the preferred grouping preference of the compliance holder;

assigning a distinct grouping preference for each of the plurality of compliance holders;

determining, for each of the plurality of pharmaceutical medications, an appropriate grouping preference for the pharmaceutical medication from the distinct grouping preferences of the plurality of compliance holders;

determining, for each of the individualized pharmaceutical containers, an appropriate compliance holder for the individualized pharmaceutical container by matching the appropriate grouping preference for the pharmaceutical medication disposed in the individualized pharmaceutical container to the compliance holder assigned the same grouping preference; and securing each of the individualized pharmaceutical containers to one of the plurality of retainers of the appropriate compliance holder for the individualized pharmaceutical container.

* * * * *